US006425295B1

(12) United States Patent
Meginniss

(10) Patent No.: US 6,425,295 B1
(45) Date of Patent: Jul. 30, 2002

(54) THREE POINT FORCE SENSING SYSTEM FOR A TOOTHBRUSH

(75) Inventor: Stephen M. Meginniss, Seattle, WA (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/643,119

(22) Filed: Aug. 21, 2000

(51) Int. Cl.[7] ..... G01D 7/00
(52) U.S. Cl. ..... 73/862.046
(58) Field of Search ..... 73/862.041, 862.042, 73/862.043, 862.044, 862.045, 862.046; 15/22.1, 22.4, 105

(56) References Cited

U.S. PATENT DOCUMENTS 4,476,604 A * 10/1984 White et al. ..... 15/22
4,680,825 A * 7/1987 White ..... 15/105
5,355,544 A * 10/1994 Driksing ..... 15/105
5,784,742 A * 7/1998 Giuliani et al. ..... 15/22.1
5,876,207 A * 3/1999 Sundius et al. ..... 15/105
5,974,615 A * 11/1999 Schwarz-Hartmann et al. ..... 15/22.4

* cited by examiner

*Primary Examiner*—Max Noori
(74) *Attorney, Agent, or Firm*—Jensen & Puntigam, P.S.

(57) ABSTRACT

The three point force sensing system includes three spaced sensor members which change in resistance linearly or monotonically over a selected range of force applied thereto. The sensor members are arranged in a triangle configuration in a flex circuit which is positioned between a brushhead and a brushhead body. The brushhead has three raised portions on a lower surface thereof which bear against the sensor members in a spring-like relationship. Electrically conductive trace lines extend from the sensor members along the length of the toothbrush to a connector at the rear end thereof. A microprocessor is used to evaluate the change of resistance as force is applied against the brushhead to determine force in the z direction against the teeth, as well as motion in the x and y direction in a plane parallel with a base portion of the brushhead.

13 Claims, 4 Drawing Sheets

| COL 1 | COL 2 | COL 3 | COL4 |
|---|---|---|---|
| | FORCE SENSOR | APPROXIMATE PAD RESISTANCE | CHANGES |
| MAJOR AXIS FORCE DIRECTION (SEE FIG. 1) | FORCE SENSOR #40 (SEE FIG.1) | FORCE SENSOR #42 (SEE FIG.1) | FORCE SENSOR #44 (SEE FIG.1) |
| +Z (DOWN ON BRISTLE TIPS) | INCREASE (1/2 OF44) | INCREASE (1/2 OF44) | INCREASE |
| +X (ACROSS BRISTLE TIPS-LEFT | INCREASE EQUAL TO 42 | DECREASE EQUAL TO 40 | NO CHANGE |
| -X (ACROSS BRISTLE TIPS-RIGHT | DECREASE EQUAL TO 42 | INCREASE EQUAL TO 40 | NO CHANGE |
| +Y (AXIAL TOWARDS TIP) | DECREASE EQUAL TO 42, (1/2 OF 44) | DECREASE EQUAL TO 40, (1/2 OF 44) | INCREASE (2X OF 40/42) |
| -Y (AXIAL TOWARDS HANDLE) | INCREASE EQUAL TO 42, (1/2 OF 44) | INCREASE EQUAL TO 40, (1/2 OF 44) | DECREASE (2X OF 40/42) |

FIG. 6

THREE POINT FORCE SENSING SYSTEM FOR A TOOTHBRUSH

TECHNICAL FIELD

This invention relates generally to a force sensing system for toothbrushes, and more specifically concerns such a system which uses three spaced sensors to determine force in three dimensions.

BACKGROUND OF THE INVENTION

It is generally well accepted that the use of excessive force (force=pressure×area) against the teeth with a toothbrush during brushing over an extended period of time can cause wear on gum tissues and eventually the teeth enamel. The problem of excessive brush force is known to be widespread. Although excessive force can be applied by both manual and power toothbrushes, a power toothbrush will typically substantially increase the effects of excessive force. It is thus desirable that a user have a reliable indication when excessive force is being applied to the teeth, so that the force can be quickly reduced by the user.

Very few, if any, commercial toothbrushes include a force indicator. Since the tendency of individual users is to exert too much force against the teeth, and since the effects of excessive force are certainly detrimental, it is desirable to develop a reliable, accurate force sensor, one which is simple to use and yet is economical to include on a toothbrush.

Various pressure and force sensors are known which measure brushing force in different ways, including both mechanical and electrical sensors. Some sensors measure pressure while others measure actual force. Force sensors are generally desirable over pressure sensors because pressure sensors are sensitive to the size of the loaded member (the brushhead) pushing against the sensor and/or the relative positions of the loaded member and the sensor. Pressure sensors can, however, be converted to force sensors by including a shaped protrusion (bump) of a selected area on the sensor to significantly reduce, if not eliminate, the sensitivity of the sensing system to size, shape and/or position of the loaded member (which can in fact be flat).

Some sensors use a piezoelectric device to measure the rate of deflection of the sensor and provide velocity information concerning movement of the member, rather than force or pressure information. Still other sensors use strain gauges, some of which incorporate temperature compensation elements.

In addition, there are sensors which make use of particular materials which include a characteristic, such as electrical resistance, which changes upon application of pressure or force over a given range. Information from these pressure or force elements is then compared against a threshold to provide an indication of when a threshold value of excessive pressure or force is exceeded.

SUMMARY OF THE INVENTION

Accordingly, the present invention is a three point force sensing system for a toothbrush, comprising: a toothbrush body; three spaced sensor members responsive to force thereon, positioned in the toothbrush body beneath a brushhead which is mounted in such a manner that the brushhead moves relative to the sensor members in response to force thereon against the teeth of a user, the sensor members having a selected characteristic which changes upon application of force on the sensor members; sensor member connectors which extend from the three sensor members and which are connectable to a processor for calculating force on the brushhead in response to changes in said characteristic of the three sensor members, and three raised bump-like portions on the bottom surface of the brushhead which contact the three sensor members, such that change in force on the brushhead changes the force on the sensor members through the three raised portions, thereby producing an identifiable change in the selected characteristic of the sensor members, so that force of the bristles/tips of the brushhead against the teeth of a user can be determined.

BRIEF DESCRIPTION OF THE DRAWINGS

FIG. 6 is a table showing the response of the individual sensors of the force sensing assembly of FIG. 1 in response to various forces.

BEST MODE FOR CARRYING OUT THE INVENTION

Figures 1, 2:
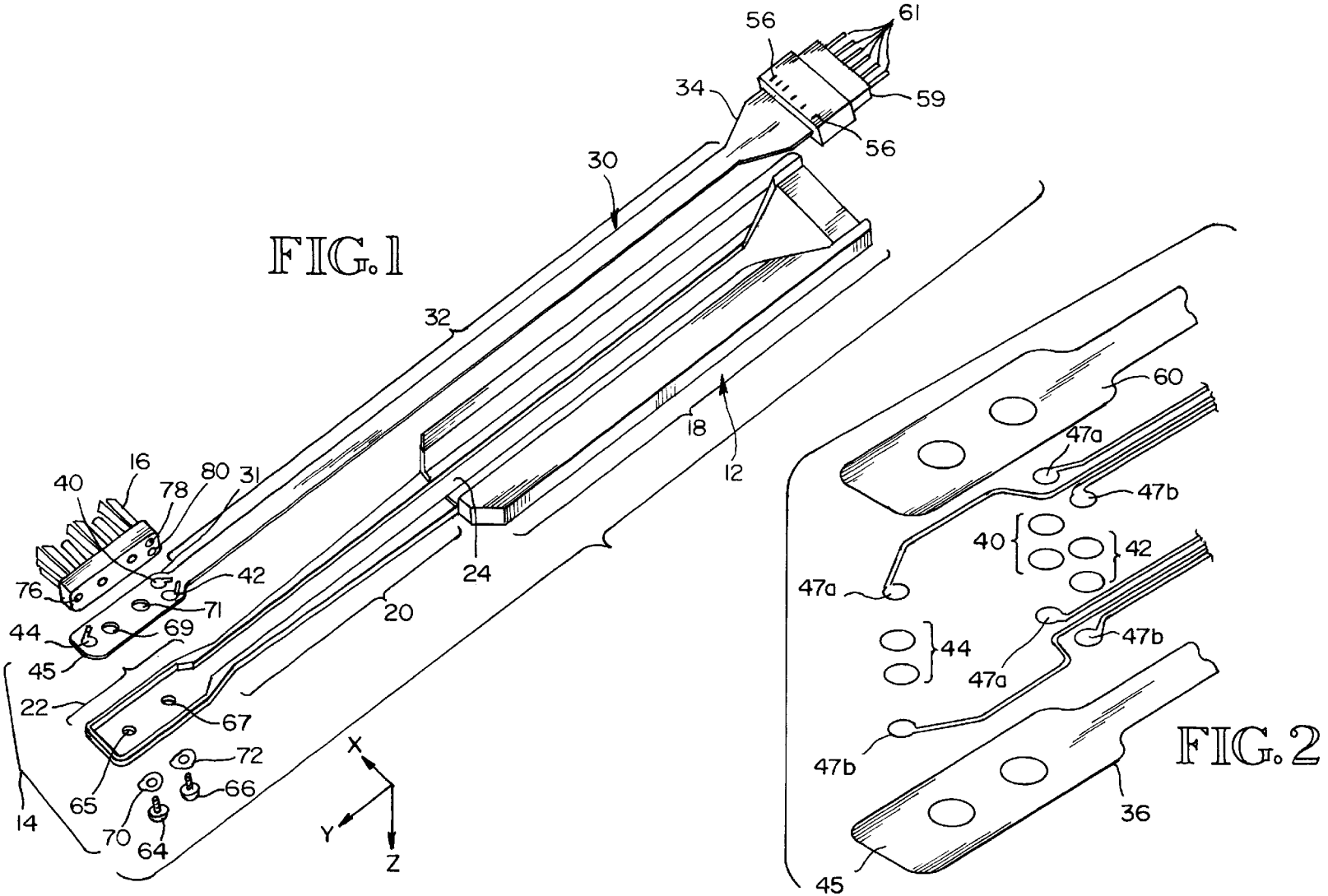
FIG. 1 is an exploded view showing the basic parts of the force sensing assembly of the present invention in a toothbrush.
FIG. 2 is an exploded view of the force sensing assembly of FIG. 1.

FIG. 1 shows a toothbrush generally at 10 which includes an elongated toothbrush body 12, a force sensing assembly generally at 14 and a brushhead member 16. Toothbrush 10 in FIG. 1 is a manual toothbrush, which is the typical toothbrush environment for the present invention. In the embodiment shown, toothbrush body 12 includes a generally flat handle portion 18, a neck portion 20, which extends forward from handle 18, and a receiving portion 22 which receives brushhead member 16.

In the embodiment shown, toothbrush body 12 is made of a plastic material, such as polypropylene, nylon or propinate. The total length of the toothbrush body is 7–½ inches, with a height of 0.3–0.5 inches. Handle portion 18 is approximately 1 inch wide, while the neck portion is approximately 0.75 inches wide at its point of joinder with handle 18 and then tapers slightly to where it joins receiving portion 22, at which point the toothbrush body widens out slightly to accommodate brushhead member 16.

Extending longitudinally along the neck portion 18 from where it joins brushhead receiving portion 22 and then to rear end 23 of handle portion 18 is a slot 24, which in the embodiment shown is approximately 0.15 inches deep and over most of its length is approximately 0.20 inches wide. Near rear end 23 of handle 18, slot 24 widens out until at rear end 23, slot 24 extends substantially across the width of handle 18.

The above description of the handle and the neck portions of the toothbrush is for illustration only. A wide variety of configurations and sizes of such toothbrush portions are possible. The handle and the neck, for instance, could be circular or oval in cross-section or other shapes, as desired.

Positioned in slot 24 and extending from the forward end 25 of the toothbrush body to the rear end 13 thereof is a flex circuit 30, which forms a major part of the force sensing assembly of the present invention.

Figure 3:
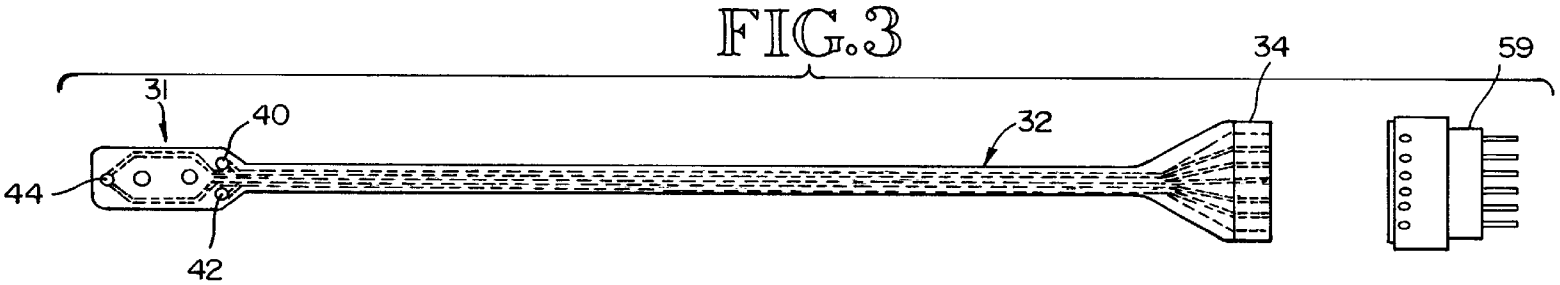
FIG. 3 is a top view of the force sensing assembly of FIG. 2.

Flex circuit 30 includes a head portion 31 (approximately 0.357 inches wide) which fits within the receiving portion 22 in the toothbrush body, an elongated central portion 32 (approximately 0.170 inches wide) and a connector portion 34 at the very rear of the handle portion. Central portion 32 and connector portion 34 fit into slot 24 along the length of the toothbrush body. Flex circuit 30 is shown in more detail in FIGS. 2 and 3. Flex circuit 30 includes a lower layer 36, approximately 0.003 inches thick, of clear or colored polyester film such as Mylar, with a pressure sensitive adhesive on the bottom side thereof, for attachment of the flex circuit 30 to toothbrush body 12, specifically, the lower surface of slot 24 and the interior surface of brushhead receiving portion 22.

The flex circuit 30 includes three force sensitive, circular sensor pad assemblies 40, 42 and 44. The sensor pad assemblies 40, 42 and 44 are made of pressure sensitive ink and can be purchased from various sources, including Tekscan (solid disk type force sensors such as shown in U.S. Pat. No. 5, 989, 700.) Interlink and IMR Corp (interdigitated finger type pressure sensors). The interdigitated finger type sensor is sensitive to the shape, size and location of the loading member pressure on the sensor's surface. This sensitivity to the shape, size, and location of the loading member can be substantially reduced or eliminated by applying a shaped bump of a selected size on the sensor. Each sensor pad assembly consists of two disk portions (as shown) of pressure sensitive, silver or carbon silver ink, with each pad assembly having connecting layers 47*a*–47*b* of polyester printed on the outer surfaces of the two disk portions, respectively.

In the embodiment shown, pad assemblies 40 and 42 are positioned toward the rear of the head portion of the flex circuit, approximately 0.81 inches longitudinally from the forward end 45 of the flex circuit and separated by approximately 0.16 inches. The third pad assembly 44 is located approximately 0.09 inches from the forward end 45 of the flex circuit and is positioned substantially intermediate between pad assemblies 40 and 42 in the lateral direction. Pad assemblies 40, 42 and 44 form a narrow triangle when their center points are connected.

Other geometric relationships of these pad assemblies can be used to obtain the same force information. For instance, pad assemblies 40 and 42 could be positioned forwardly near the tip of the brush base and pad 44 rearwardly near the handle. Three pad assemblies are desired for proper operation, but it is possible to use one pad assembly in combination with other stabilizing elements which are spaced about the one sensor pad assembly.

The force sensitive pad assemblies change total resistance upon application of force and have a linear, or monotonic, output from 20–1000 grams of applied force. Connected to each of the pad assemblies 40, 42 and 44 respectively and extending to the rear of the toothbrush are two thin electrical traces, as shown most clearly in FIG. 4. The traces are connected to the sensor pad assemblies through two silver ink connecting layers 47*a*–47*b* to each sensor pad. In one particular embodiment, the inner surface both of upper and lower Mylar layers 36 and 60 has a silver ink layer and a pressure sensitive ink pad disk printed on it. The two Mylar layers are then positioned against each other, with a slight space between them caused by the pressure sensitive adhesive between the two Mylar layers. There is no adhesive between the two ink pad disks. Connected to pad assembly 44 are traces 46 and 48, while connected to pad assembly 40 are traces 50 and 52, and connected to pad assembly 42 are traces 54 and 56. The traces in the embodiment shown are silver or carbon silver ink. The traces are connected to the sensor pad assemblies in such a way that the resistance of the pad assemblies, specifically the changing resistance of the two individual disk elements can be measured through the traces. It is also possible to use just four traces, one trace for each of the three pad assemblies and one trace being common.

Other flex circuit arrangements are possible as well. The circuit could be made from a polyimide (Kapton) film with etched copper traces, or the lower half of the circuit could be a fiberglass printed circuit board while the upper half of the circuit could be polyester film. In any case at least one of the halves (upper/lower) of the flex circuit must be of a flexible material. Also, arrangements other than flex circuits can be used to connect the three sensors to a processing apparatus.

Each pair of traces in the embodiment shown extends longitudinally from their associated sensor pad assembly in slot 24 along the neck and handle portions of the toothbrush body and then at the rear of the handle portion fan out and are connected to individual spaced finger-like connector elements 56—56, as shown in FIG. 1. A flex circuit connector 59 receives the connector elements 56—56. On the opposing side of connection 59 are metal pin connectors 61—61. The connector 59 is secured to the rear end of the handle portion.

Upper layer 60 of the flex circuit is also of clear Mylar, 0.0005–0.003 inches thick in the embodiment shown. Upper layer 60 is sealed to the lower layer 36 so that the pad assemblies and the traces are in a water resistant or waterproof environment. The adhesive between upper layer 60 and lower layer 36 of the flex circuit is sufficiently thick to result in a slight separation between the two pressure-sensitive ink disk portions of each pad assembly. The flex circuit is, however, slightly preloaded, as discussed below, to result in the two disk portions slightly touching prior to any pressure being applied by the user. In manufacturing the flex circuit, it is possible to have one connector and its associated electrical trace printed onto one longitudinal half of a single double-width Mylar layer with the Mylar layer then being folded longitudinally in such a manner so that the one secured connector comes into contact with its associated disk portion positioned with the remainder of the pad assembly on the other half of the Mylar layer.

The metal pins 61 in connector 59 are adapted to receive a mating connector which leads to a microprocessor (not shown) which calculates the force in three directions from the change of resistance of the sensor pad assemblies 40, 42 and 44, as the force on the brushhead changes during brushing action. The microprocessor can be miniaturized and battery powered to fit within the toothbrush handle, along with a means to provide force information to the user.

Figure 4:
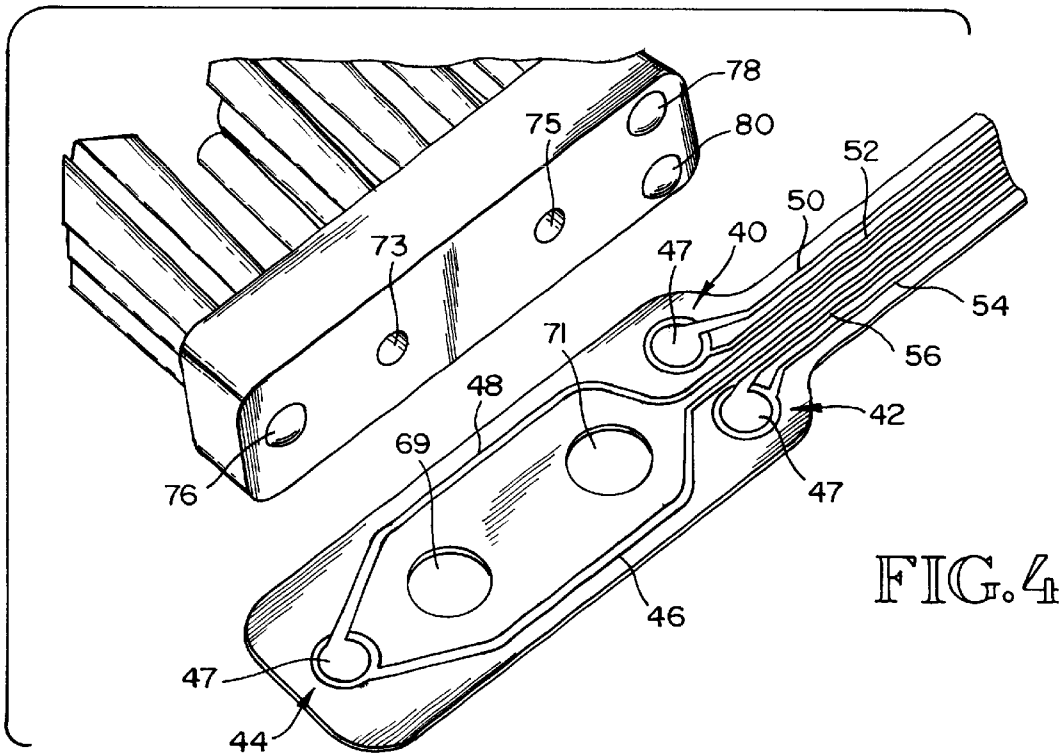
FIG. 4 is a close-up view of a portion of the force sensing assembly of FIGS. 1–3.

FIGS. 1 and 4 show the attachment of the brushhead to the brushhead receiving portion of the toothbrush body, with the head portion of the flexible circuit therebetween. FIGS. 1 and 4 also show three contact bumps, 76, 78, and 80 on the bottom surface of the brushhead which contact and are preloaded against the three sensor pad assemblies, 40, 42, 44 in the flex circuit 30. In an alternate arrangement, the contact bumps could be attached to the surface of flexible circuit. The three bumps in either arrangement are an important part of the overall geometry force sensing system of the present invention and will be addressed in more detail below.

The brushhead is attached to the toothbrush body by two machine screws 64 and 66. The machine screws in the embodiment shown extend through two spaced openings 65 and 67 in the brushhead receiving portion 22 of toothbrush body 12. The openings 65, 67 are sufficiently large to permit movement of the brushhead in the direction relative to the brushhead receiving portion 22. The openings are separated by 0.312 inches and are located at a midpoint laterally between the side edges of the brushhead receiving portion. The two openings 65 and 67 are located longitudinally between the two pad assemblies 40 and 42 at one end and pad assembly 44 at the other end.

The machine screws 64 and 66 also extend through two similarly spaced openings 69 and 71 in the head portion of the flex circuit (FIG. 1) wherein openings 69 and 71 are in registry with openings 65 and 67 in the brushhead receiving portion 22. The machine screws 64, 66 are screwed into two mating openings 73, 75 in the lower surface of brushhead 16 (FIG. 4). Other types of fasteners could be used instead of the machine screws to hold the brushhead and the brushhead receiving portion. Located between the heads of the machine screws 64, 66 and the lower surface of the brushhead receiving section 22 are two curved spring washers 70 and 72.

This arrangement maintains a spring contact force between the three bumps or legs 76, 78 and 80 located on the lower surface 76 of brushhead 16 and the sensor pad assemblies 40, 42 and 44 in the flex circuit. This arrangement produces the "preloading" effect mentioned above bringing the two pressure sensitive disks in each pad assembly into contact with each other. The spring force is sufficiently high that none of the three bumps or legs lift off the sensor pad assemblies during normal brushing. The spring force is required to measure negative force in the z direction. The force on the pad assemblies must always be positive. When the brushhead is attached to the brushhead receiving portion of the toothbrush body, the bumps 76, 78 and 80 are in registry with and bear against the upper surface of sensor pad assemblies 40, 42 and 44. Upon the application of force against the brushhead, a change of resistance of each ink pad assembly (the two disks) results, depending upon the location and direction of the forces.

The three-pad arrangement shown is capable of measuring force on the toothbrush bristles/tips in any direction, i.e. force in any of the three orthogonal axes x, y and z, with the z axis being parallel with the direction of the bristles, i.e. toward the brushhead base, the x axis being side to side across the brush and the y axis being in the direction of the handle axis. This is illustrated by the three axis "arrow" diagram shown in FIG. 1.

The force along the z axis basically represents the force of the bristles on the gums and the teeth during brushing and is to be maintained below a selected maximum threshold in order to prevent damage to the tissues and enamel, or in a selected operating range for effective cleaning, or above a minimum threshold for effective cleaning. The forces in the x and y directions, both of which are parallel to the base of the brushhead, represent the forces associated with the actual motion of the brush, e.g. up/down, back/forth or combinations thereof. For instance, an elliptical or circular motion is typically recommended by dental professionals as the brush is moved around inside the mouth.

The present invention permits the relative forces in the x, y plane to be analyzed to see if proper brush motion is being used, as well as independently monitoring the z axis force for force against the teeth. For instance, a z axis change in force applied at the center of the brushhead, will result in a change of resistance in all three sensor pads, with the change in the resistance of sensor pad assemblies 40 and 42 being one-half that of the change in resistance of sensor pad assembly 44. As briefly indicated above, however, it should be understood that it is possible to provide z axis force information with a single sensor pad assembly, if the brushhead is appropriately stabilized relative to the single sensor pad.

When the brush is moved in the x and/or y axis directions, the resistance of sensor pad assemblies 40 and 42 will change in a complementary manner, as shown in the table of FIG. 6. Force on the brushhead in both the x and y directions, respectively, can be determined, and from that information, brush movement in the x-y plane thus can be calculated. The sensor pad assembly forces, along with the brush geometry, thus can be used with conventional calculation and logic techniques to both monitor brush movement and a user's brushing technique. The table of FIG. 6 provides more information concerning the action of the force sensors. In columns 2, 3 and 4 where an increase in resistance is noted, the spring washer pre-loaded force and applied force together cannot, however, exceed the load capacity of the sensor pad assembly. Further, where a decrease in resistance is noted, the spring washer pre-load force on an individual force sensor pad assembly cannot be exceeded or the sensor reading will terminate.

In operation, the three bumps 76, 78 and 80 on the underside of the brushhead are held against the three sensor pad assemblies 40, 42 and 44 by the combination of the two screws 64 and 66 and the spring washers 70 and 72, as shown in the drawings. The three pad assemblies as explained above are connected through the electrically conductive traces to the connector 59 at the rear end of the handle. The connector 59 connects the traces to a microprocessor (not shown) which can, as indicated above, be battery powered and positioned in the handle of the toothbrush. The microprocessor will compute the actual force vectors along the three orthogonal axes. An indication of z axis force of the brushhead against the teeth as well as x-y relative forces (and by calculation x-y brush movement) can be determined by appropriate calculation from the force information in the three axial directions.

Figure 5:
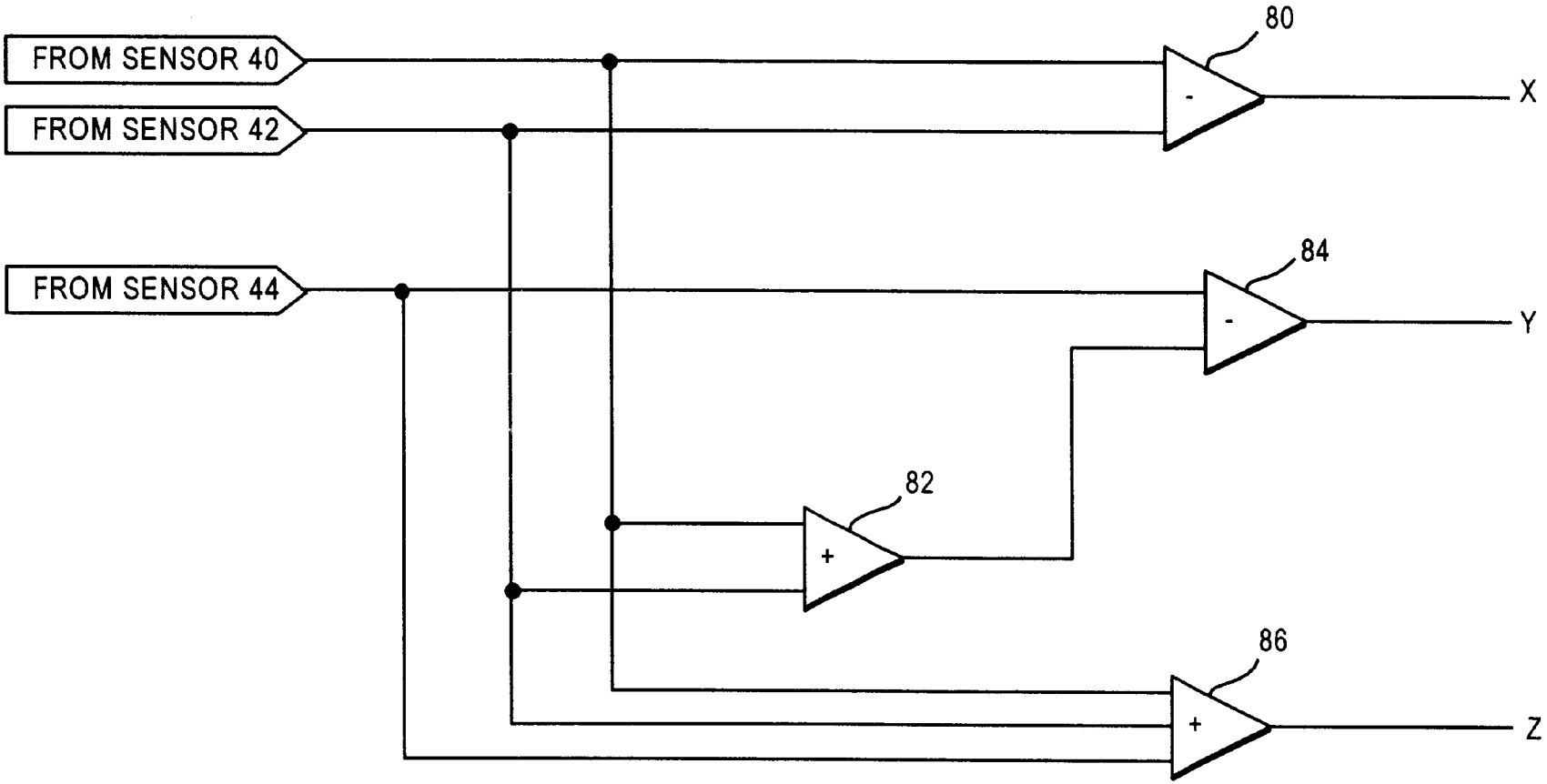
FIG. 5 is a simplified logic diagram showing the operation of the force sensing assembly of FIGS. 1–4.

FIG. 5 shows a logic diagram for initial steps in making the 3 axis force calculations. The force in the x axis direction is developed from the difference between the forces on pad assemblies 40 and 42 through a subtract circuit 90. The force in the y direction is developed from adding the forces on pad assemblies 40 and 42, with that value then being subtracted from the force on pad assembly 44, using adder 92 and subtractor 84. The force in the z direction is determined by adding the forces on the three pad assemblies with adder 86.

The resulting force and/or brush motion information can then be provided to the user in the form of an alarm of some kind, including for example, auditory, visual or tactile. The alarm signals to the user that the force in the z axis direction is over the set maximum threshold and also provides information that the brushing motion (x and y direction) has desirable (or undesirable) characteristics. A signal can also be provided, indicating that the force is greater than a minimum threshold for effective cleaning as well as being within a range for proper cleaning. Different colored lights (or other visual, auditory, or tactile signals)can be used, indicating that the force (1) is above a minimum force threshold, (2) is in a correct range for proper cleaning, (3) above a maximum force threshold or 4) corresponds to proper brushing technique or not. Further, an analysis of a user's brushing technique/effectiveness can be displayed in an LCD or other type of readout at the end of each brushing event.

A preferred embodiment of the invention has been disclosed for purposes of illustration. It should be understood, however, that changes to the preferred embodiment can be readily made. The configuration and arrangement of the toothbrush body can be altered both longitudinally and in cross-section. Further, the flex circuit can be sealed within the toothbrush body along the length thereof. Also, the means for attaching the brushhead to the toothbrush body can be varied. The invention is defined by the claims which follow.

What is claimed is:

1. A three point force sensing system for a toothbrush, comprising:

a toothbrush body;

three separate, independent, spaced sensor members responsive to force thereon, positioned in the toothbrush body beneath a brushhead which is mounted in such a manner that the brushhead moves relative to the sensor members in response to force on the brushhead against the teeth of a user, the sensor members having a selected characteristic which changes value upon application of force on the sensor members;

sensor member connections extending from the three sensor members and connectable to a processor for calculating force on the brushhead in response to changes in said characteristic of the three sensor members; and three raised portions on a bottom surface of the brushhead which contact the three sensor members, such that change in force on the brushhead changes the force on the sensor members through the three raised portions, thereby producing an identifiable change in the selected characteristic of the three sensor members, so as to permit determination of force in the direction of the bristles on the brushhead against the teeth of a user and also force in a plane parallel with a base portion of the brushhead.

2. An apparatus of claim 1, wherein the sensor members are located in the same lateral plane near a proximal end of the brushhead and the third sensor member is located near a distal end of the brushhead approximately midway laterally between the lateral position of the first and second sensor members.

3. An apparatus of claim 1, wherein the connections are electrically conducting trace connectors which extend between each of the sensor members and a connector assembly located in the vicinity of a rear end of the toothbrush body.

4. An apparatus of claim 1, wherein the connections are electrically conducting trace connections which extends between each of the sensor members and a processing circuit located on the toothbrush body.

5. An apparatus of claim 3, wherein the sensor members and the trace connectors form part of a waterproof flexible circuit.

6. An apparatus of claim 5, wherein the sensor members include pad assemblies of force sensitive ink.

7. An apparatus of claim 6, wherein the sensor members each include two pads of force sensitive ink approximately in registry with each other and two electrically conducting connector members on opposed outer surfaces of the two pads, the trace connectors extending from the connector members.

8. An apparatus of claim 7, including means for preloading the sensor members so that the two pads in each sensor assembly contact each other without any pressure applied by the user.

9. An apparatus of claim 1, wherein the selected characteristic of the sensor members is the resistance thereof, which changes in a known fashion over a selected range of force applied thereto.

10. An apparatus of claim 9, wherein the selected range is 20–1000 grams of force.

11. An apparatus of claim 1, wherein the raised portions are an integral part of a base portion of the brushhead.

12. An apparatus of claim 8, wherein the flexible circuit with the sensor members therein is held between the brushhead body and the raised portion of the brushhead in a preloaded condition by two spaced spring assemblies which permits the brushhead to move slightly relative to the toothbrush body, including toward and away from the toothbrush body, in response to force on the brushhead.

13. An article of claim 9, wherein change of resistance of the three sensor members permits determination of force in the direction of the bristles against the teeth and also relative motion in a plane parallel with a base portion of the brushhead.

* * * * *